US007424792B1

(12) United States Patent
Sorkin

(10) Patent No.: US 7,424,792 B1
(45) Date of Patent: Sep. 16, 2008

(54) POSITIVELY RETAINED CAP FOR USE ON AN ENCAPSULATED ANCHOR OF A POST-TENSION ANCHOR SYSTEM

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 639 days.

(21) Appl. No.: 10/756,775

(22) Filed: Jun. 14, 2004

(51) Int. Cl.
*E04C 5/08* (2006.01)

(52) U.S. Cl. ..... 52/223.13; 52/223.6; 52/742.14

(58) Field of Classification Search ..... 52/223.1, 52/223.14, 223.6, 223.16, 223.13; 24/464, 24/459, 122.6
See application file for complete search history.

(56) References Cited

U.S. PATENT DOCUMENTS 4,896,470 A 1/1990 Sorkin
5,072,558 A 12/1991 Sorkin
5,440,842 A 8/1995 Sorkin
5,755,065 A 5/1998 Sorkin
5,839,235 A * 11/1998 Sorkin ..... 52/223.13
6,023,894 A 2/2000 Sorkin
6,381,912 B1 * 5/2002 Sorkin ..... 52/223.13
6,817,148 B1 * 11/2004 Sorkin ..... 52/223.13

* cited by examiner

*Primary Examiner*—Richard E. Chilcot, Jr.
*Assistant Examiner*—Anthony N Bartosik
(74) *Attorney, Agent, or Firm*—Egbert Law Offices

(57) ABSTRACT

An anchor assembly for a post-tension system has an anchor member, a polymeric encapsulation covering the anchor member and defining a tubular section extending outwardly of an end surface of the anchor member, a rigid ring affixed within this tubular section and having a notch formed in an inner wall thereof, and a cap having a generally tubular body with an open end and a closed end. The cap has a flanged end adjacent the open end thereof. This flanged end has an outer periphery engageable within the notch of the rigid ring.

9 Claims, 3 Drawing Sheets

POSITIVELY RETAINED CAP FOR USE ON AN ENCAPSULATED ANCHOR OF A POST-TENSION ANCHOR SYSTEM

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to post-tension anchorage systems. More particularly, the present invention relates to caps that are used for closing an end of the anchor and for encapsulating an exposed end of a tendon extending through the anchor. Furthermore, the present invention relates to improved locking mechanisms for causing the cap to be properly joined to the polymeric encapsulation of the anchor.

BACKGROUND OF THE INVENTION

For many years, the design of concrete structures imitated typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive (vertical) load, is extremely weak in carrying significant tensile loads. It becomes necessary, therefore, to add steel bars, called reinforcements, to concrete, thus allowing the concrete to carry the compressive forces and the steel to carry the tensile (horizontal) forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as 100 feet can be attained in members as deep as three feet for roof loads. The basic principal is simple. In prestressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principal, but the reinforcing is held loosely in place while the concrete is placed around it. The reinforcing is then stretched by hydraulic jacks and securely anchored into place. Prestressing is done with individual members in the shop and post-tensioning as part of the structure on the site.

In a typical tendon tensioning anchor assembly in such post-tensioning operations, there is provided a pair of anchors for anchoring the ends of the tendons suspended therebetween. In the course of installing the tendon tensioning anchor assembly in a concrete structure, a hydraulic jack or the like is releasably attached to one of the exposed ends of the tendon for applying a predetermined amount of tension to the tendon. When the desired amount of tension is applied to the tendon, wedges, threaded nuts, or the like, are used to capture the tendon and, as the jack is removed from the tendon, to prevent its relaxation and hold it in its stressed condition.

Metallic components within concrete structures may become exposed to many corrosive elements, such as de-icing chemicals, sea water, brackish water, or spray from these sources, as well as salt water. If this occurs, and the exposed portions of the anchor suffer corrosion, then the anchor may become weakened due to this corrosion. The deterioration of the anchor can cause the tendons to slip, thereby losing the compressive effects on the structure, or the anchor can fracture. In addition, the large volume of by-products from the corrosive reaction is often sufficient to fracture the surrounding structure. These elements and problems can be sufficient so as to cause a premature failure of the post-tensioning system and a deterioration of the structure.

Various attempts have been made in the prior art to reduce or eliminate the potential for corrosion within the wedge cavity of the anchor. For example, U.S. Pat. No. 5,024,032, entitled "Post-Tensioning Anchor" and issued to Rodriguez on Jun. 18, 1991, discloses a post-tension anchor and cap. The cap friction fits with the anchor in an effort to enclose the wedge cavity from external materials. The friction-fitting cap includes tabs or so-called "ears" around which securing filaments are tied. The securing filaments are purported to retain the cap within a press-fit engagement of the anchor, thereby precluding corrosives or contaminants from reaching the wedge cavity of the anchor.

U.S. Pat. No. 4,918,887, entitled "Protective Tendon Tensioning Anchor Assembly" and issued to Davis et al. on Apr. 24, 1990, discloses the combination of an anchor plate, a sealing cap and a resilient sealing ring. The combination is used in an effort to seal the wedge assembly of the anchor from the external environment. The combination represents a relatively complicated configuration for a sealing cap wherein various locking fingers and a specially shaped sealing ring are necessary in an effort to seal the wedge cavity of the anchor from external contaminants.

U.S. Pat. No. 4,773,198, entitled "Post-Tensioning Anchorages for Aggressive Environments", and issued to Reinhardt on Sep. 27, 1988, discloses an alternative anchor and sealing cap assembly. The sealing cap is provided with threads for threading into a lip of the anchor plate for fluid sealing. Alternative seals such as "snap rings, bayonet fittings or other" fittings are also discussed.

U.S. Pat. No. 4,719,658, entitled "Hermetically Sealed Anchor Construction For Use In Post Tensioning Tendons", and issued to Kriofske on Jan. 19, 1988, discloses an anchor and "plug" for fitting to the anchor. The plug includes a grease fitting through which grease may be injected, thereby forcing it into the cavities surrounding the anchor.

U.S. Pat. No. 5,440,842, issued on Aug. 15, 1995, to the present inventor, describes one technique for sealing and anchor. In this patent, a cap is provided with a O-ring seal disposed inwardly of a lip at the end of the cap. When the cap is pushed into the interior of the tubular section of the anchor, the elastomeric seal will engage the walls of the tubular section in a generally friction-fit relationship. As such, the cap will be retained properly in place. Unfortunately, this device could be easily dislodged or improperly placed. It is also possible that the cap could be improperly installed and this improper installation would not be noticeable upon inspection. As such, a need developed for a positive snap-fit connection between the cap and the anchor.

U.S. Pat. No. 6,023,894, issued on Feb. 15, 2000 to the present inventor also describes an improved cap connection for an anchor of a post-tension system. The improved cap has a flanged end adjacent to an open end of the tubular body of the cap. This flanged end has a circumferential surface. A locking member is formed on the circumferential surface for detachably engaging the protrusion such that the flanged end is fixedly received within the tubular section. A compressible seal is affixed within the polymeric encapsulation and extends around the end surface. The cap has an annular surface extending around the open end and in compressible contact with the compressible seal when the locking member engages the protrusion.

FIG. 1 is illustrative of a post-tension system of the prior art showing a typical cap connection. In particular, in FIG. 1, the post-tension system 10 includes a sealing cap 12 intended to be fitted in sealed relationship within the interior of the open end of the anchor 14. The anchor 14 supports the end 16 of a tendon. The tendon is locked in place with respect to the anchor 14 by wedges 18 and 20 disposed within a wedge cavity of the anchor 14. The anchor 14 includes an encapsulation 22 extending around a steel anchor body therein. The polymeric encapsulation 22 is encapsulated by injection molding the polymeric encapsulation 22 around the steel anchor body. A tubular section 24 is formed of the polymeric encapsulation 22 and extends outwardly of the anchor body. A rigid ring 26 is secured by injection molding the polymeric encapsulation 22 over the rigid ring 26. The rigid ring 26 is illustrated at having a smooth inner surface facing the tendon 16.

In FIG. 1, it can be seen that the anchor 14 includes a rear tubular member 28 which communicates with the tubular section 24. An extension tube 30 will fit in snap-fit connection or in friction-fit relationship over the rear tubular member 28. The extension tube 30 overlies a sheath 32 which encases the tendon 16 (the end 16 of which is shown protruding outwardly from the wedge cavity of the anchor 14). Although not shown, the end of the extension tube 30 overlying sheath 32 is sealed, by the use of tape or other means.

The sealing cap 12 is constructed of a high-density polyethylene or polypropylene material. The sealing cap 12 includes a tubular body 34 for covering the exposed end of the tendon 16 and, if required, for retaining a rust inhibitor chemical. The sealing cap 12 includes an outer lip 36 which will be ins surface-to-surface sealing friction-fit contact with the interior surface of the rigid ring 26 once the sealing cap 12 is connected to the anchor 14. The sealing cap 12 also includes an outer ridge 38 and an O-ring seal 40.

Unfortunately, with this prior art, the cap 12 is not "positively" attached within the tubular section 24 of the polymeric encapsulation 22 of anchor 14. Although this system has proven effective in preventing liquid intrusion into the interior of the anchor 14, construction engineers have required more positive connection between the sealing cap 12 and the anchor 14. By virtue of the friction-fit relationship between the sealing cap 12 and the anchor 14, it is possible for the sealing cap 12 to become dislodged by forces applied to the tubular body 34 of the sealing cap 12. In other circumstances, the O-ring seal 40 will not be positively engaged against the inner surface of the rigid ring 26. As such, a need developed so as to establish a more secure and positive relationship between the cap and the tubular section 24 of the anchor 14.

It is an object of the present invention to provide an improved cap and anchor which assures a positive connection between the cap and the anchor.

It is another object of the present invention to provide an improved cap and anchor that assures the liquid-tight engagement of the cap with the anchor.

It is a further object of the present invention to provide an improved cap which cannot be easily removed without a positive intended action for removal from the anchor.

It is still another object of the present invention to provide an improved cap which is easy to install into the anchor.

It is still a further object of the present invention to provide an improved cap and anchor which is easy to manufacture, easy to use, and relatively inexpensive.

These and other objects and advantages of the present invention will become apparent from a reading of the attached specification and appended claims.

BRIEF SUMMARY OF THE INVENTION

The present invention is an anchor assembly for a post-tension system that comprises an anchor member having an end surface, a polymeric encapsulation covering the anchor member, a rigid ring affixed within a tubular section of the polymeric encapsulation, and a cap having a generally tubular body with an open end and a closed end. The rigid ring has a notch formed on inner wall thereof. The cap has a flanged end adjacent the open end thereof. The flanged end has an outer periphery engaged within the notch of the rigid ring.

The flanged end has a end surface and an outer wall extending outwardly therefrom. The outer wall has a lip formed at an end thereof opposite the end surface of the anchor member. The lip is the outer periphery that is engaged with the notch. The outer wall has a grooves formed therein. An elastomeric seal is received within this groove and extends around the cap. The elastomeric seal is in generally liquid-tight engagement with the inner wall of the rigid ring.

In the present invention, the rigid ring is of a steel material. The polymeric encapsulation is in injection-molded relationship around the exterior surface of the rigid ring. The notch includes a first notch formed around the inner wall of the rigid ring adjacent an end of the rigid ring opposite the end surface of the anchor member. In an alternative form of the present invention, the notch includes a second notch formed around the inner wall of the rigid ring adjacent an opposite end of the rigid ring. This second notch is in spaced parallel relationship to the first notch. The rigid ring has a tapered surface at an end thereof adjacent an end of the tubular section of the polymeric encapsulation opposite the end surface of the anchor member. This tapered surface facilitates the ability to insert the periphery of the cap so as to engage the notch.

In the present invention, a tendon is affixed within the anchor member. This tendon has an end extending outwardly of the end surface of the anchor member and into the open end of the cap.

The present invention is also an improved cap for the anchor of a post-tension system. Additionally, the present invention is an improved anchor for use in a post-tension anchor system.

DETAILED DESCRIPTION OF THE INVENTION

Figure 2:
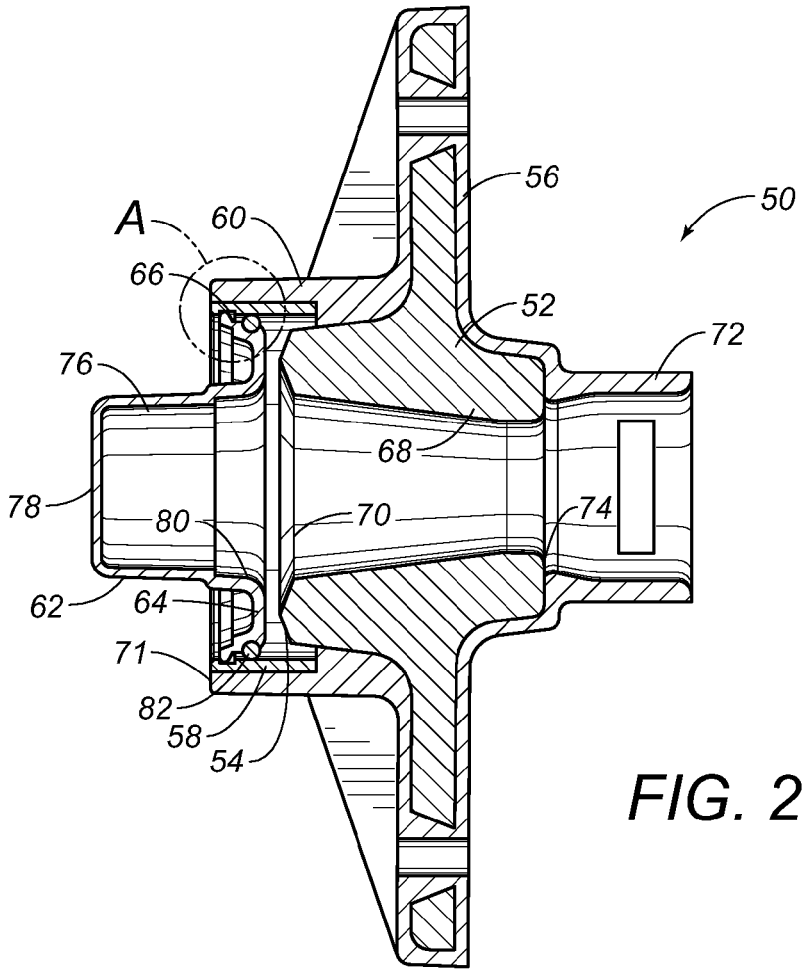
FIG. 2 is a cross-sectional view showing the anchor assembly for the post-tension anchor system in accordance with the teachings of the preferred embodiment of the present invention.

Referring to FIG. 2, there is shown the anchor assembly 50 as used in a post-tension anchor system in accordance with the teachings of the present invention. The anchor assembly 50 includes an anchor member 52 having an end surface 54, a polymeric encapsulation 56 coving the anchor member 52, a rigid ring 58 affixed within a tubular section 60 of the encapsulation 56, and a cap 62 having a flanged end 64 with an outer periphery engaged with a notch 66 of the rigid ring 58.

Figure 1:
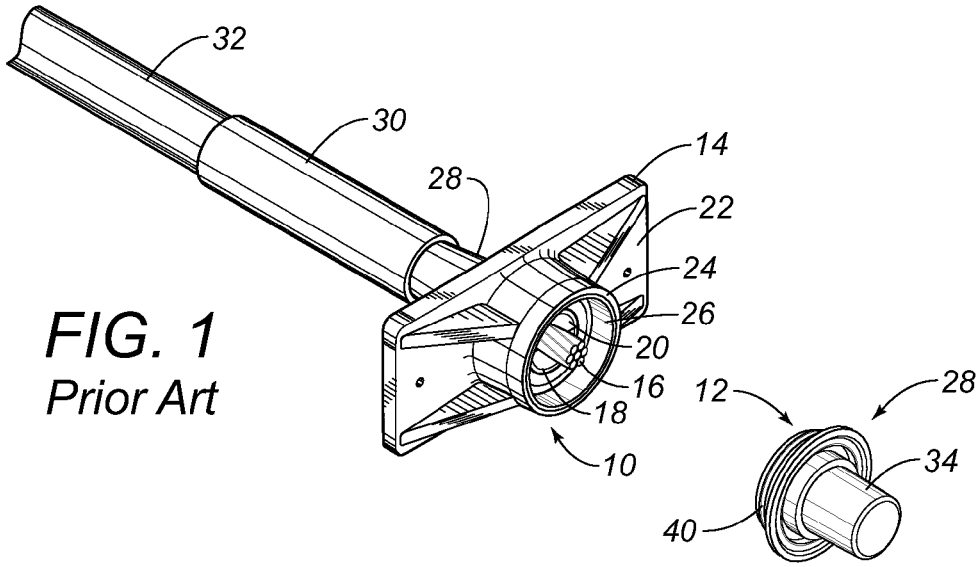
FIG. 1 Prior Art
FIG. 1 is a perspective exploded view of a prior art cap connection system as used within a post-tension anchorage system.

As can be seen in FIG. 2, the anchor member 52 is configuration similar to the anchor member as used within the prior art of FIG. 1. The anchor member 52 has a wedge cavity 68 of a tapered configuration formed centrally thereof. The end surface 58 defines the opening 70 of the wedge cavity 68 so as to allow wedges to be inserted for friction-fit engagement with the outer surface of a tendon extending therethrough.

The polymeric encapsulation 56 extends around the outer surfaces of the anchor member 52. As with the Prior Art of FIG. 1, the polymeric encapsulation 56 is injection molded over the outer surfaces of the anchor member 52 so as to be in liquid-tight relationship therewith. The tubular section 60 is formed of a polymeric encapsulation 56 and extends outwardly of the end surface 54 of the anchor member 52 so as to define an opening at the end 71 of the tubular section 60. Another tubular portion 72 extends outwardly of the opposite surface 74 of the anchor member 52. Tubular portion 72 corresponds to the configuration of tubular portion 28 of the anchor 14 of the prior art of FIG. 1.

Importantly, in the present invention, a rigid ring 58 is positioned within the tubular section 60 of the encapsulation 56. The rigid ring 58 will have an end flush with the end 71 of the tubular section 60. An opposite end of the rigid ring 58 will be adjacent to the end surface 54 of the anchor member 52. The encapsulation 56 is injection molded over the outer surface of the rigid ring 58 so as to secure the rigid ring 58 in liquid-tight relationship within the tubular section 60.

A notch 66 is adjacent to the end of the rigid ring 58 and the end 71 of tubular section 60.

As can be seen in FIG. 2, the cap 62 has a generally tubular portion 76 having a closed end 78 and an open end 80. The flanged end 64 extends outwardly adjacent to the open end 80. As can be seen, the flanged end 64 has an outer periphery that is engaged within the notch 66 formed in the rigid ring 58. An elastomeric seal 82 is positioned within grooves formed on the flanged end 64 of the cap 62 so as to establish a liquid-tight sealing relationship with the inner wall of the rigid ring 58.

As can be seen in FIG. 2, the engagement of the outer periphery of the flanged end 64 of cap 62 within the notch 66 establishes a positive connection between the cap 62 and the tubular section 60 of the encapsulation 56. The cap 62 is positioned in the manner shown in FIG. 2, the cap 62 will be rigidly and permanently secured within the open end 71 of the tubular section 60. At this time, the O-ring elastomeric seal 82 will also establish a positive liquid-tight connection between the cap 62 and the inner wall of the ring 58. As a result, the present invention avoids any possible dislodgement of the cap 62 after installation.

Figure 3:
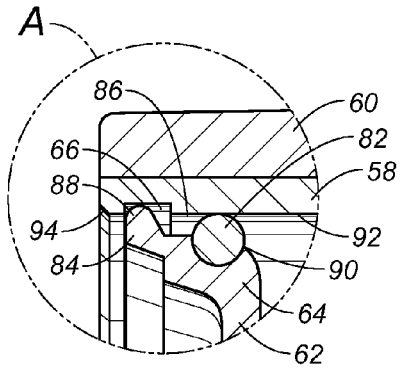
FIG. 3 is a detailed view of circled area A of FIG. 2.

FIG. 3 is a close up view of circled area A of FIG. 2. In particular, in FIG. 3, it can be seen that the cap 62 has flanged end 64 extending radially outwardly therefrom. The outer periphery 84 of the flanged end 64 is engaged within the notch 66 of the ring 58. The rigid ring 58 is of a steel material and is fixedly secured within the tubular section 60 of the polymeric encapsulation 56.

The flanged end 64 includes an outer wall 86 extending outwardly therefrom. The outer wall 86 has a lip 88 formed at an end opposite the flanged end 64. Lip 88 is suitably engaged within the notch 66 of ring 58. Additionally, a groove 90 is formed in the outer wall 86. Groove 90 is specifically configured so as to receive the elastomeric seal 82 therein. As can be seen in FIG. 3, the elastomeric seal 82 is in liquid-tight engagement with the inner wall 92 of the rigid ring 58.

In FIG. 3, the end of the end 94 of rigid ring 58 is tapered inwardly. This inwardly tapered end surface facilitates the ability to place the lip within the notch 66. The tapering of end 94 acts a funnel so as to urge the lip 88 into the notch 66. The flanged end 64 of the cap 62 is suitably deformable so as to allow the periphery 84 deform sufficiently so that the lip 88 can enter the notch 66. The lip 88 will have a flat outer surface so as to fit flush against the inner wall of the notch 66. Once the cap 62 is installed within the notch 66, in the manner shown in FIG. 3, cap 62 becomes unremovable therefrom. Additionally, and simultaneously, the elastomeric seal 82 will establish a positive liquid-tight sealing relationship with the inner wall 92 of ring 58.

Figure 4:
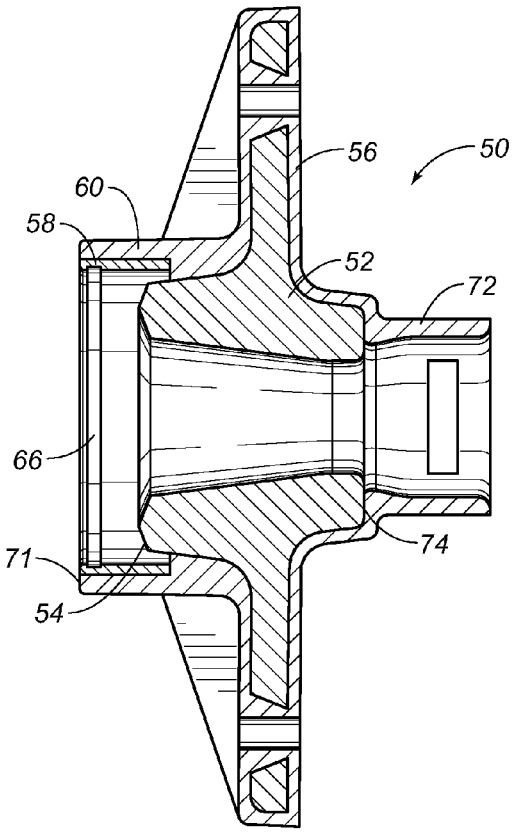
FIG. 4 is a cross-sectional view of the anchor as used in the post-tension anchor system of the present invention.

FIG. 4 shows an isolated view of an anchor assembly 50 of the present invention without cap installed therein. In particular, it can be seen that the polymeric encapsulation 56 will cover the outer surfaces of the anchor member 52. Tubular section 60 extends outwardly on one side of the end surface 54 of anchor member 52. Tubular portion 72 extends outwardly from the opposite end 74 of anchor member 52. Rigid ring 58 is installed within the tubular section 60. The notch 66 extends entirely around the inner wall of the rigid ring 58 adjacent to the end 71 of the tubular section 60.

Figure 5:
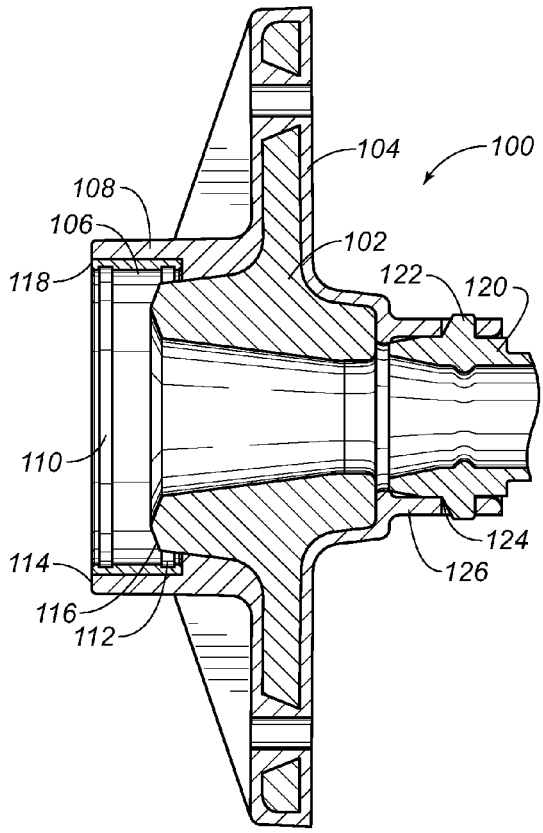
FIG. 5 shows an alternative embodiment of the anchor as used in the post-tension anchorage system of the present invention.

FIG. 5 shows an alternative embodiment 100 of the anchor assembly to that shown in FIG. 4. In FIG. 5 anchor assembly also includes an anchor member 102 with a polymeric encapsulation 104 extending thereover. A ring 106 is secured within a tubular section 108 formed of a polymeric encapsulation 104.

However, unlike FIG. 4, the rigid ring 106 includes a first notch 110 and a second notch 112. The first notch is adjacent to the end 114 of the tubular section 108. The second notch 112 is adjacent to the end surface 116 of the anchor member 102. The first notch 110 is in generally parallel spaced 106 by an identical distance to that which the second notch 112 is spaced from the opposite end of the rigid ring 106. The arrangement of notches 110 and 112 on rigid ring 106, as shown in FIG. 5, facilitates the ability to assemble the rigid ring 106 within the tubular section 108 of encapsulation 104. Since the notches 110 and 112 are located symmetrically around the inner wall 106, it will not matter whether a worker installs the rigid ring 106 one direction or another prior to encapsulation. As a result, possible errors in installation are effectively avoided. No matter what direction the rigid ring 106 is installed, one of the notches 110 and 112 will be located adjacent to the end surface 114 of the tubular section 108.

As can be seen in FIG. 5, another tubular extension 120 (similar to tubular extension 20 of FIG. 1) has a snap-fit portion 122 installed within slot 124 of tubular portion 126. As such, the present invention allows for a positive connection and union between the tubular extension 120 and the tubular portion 126 of encapsulation 104.

Figure 6:
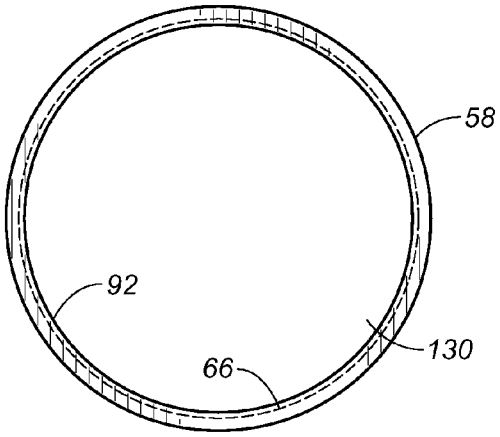
FIG. 6 is an end view of the rigid ring as used in the system of the present invention.
Figure 7:
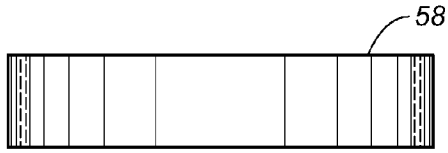
FIG. 7 is an isolated side elevational view of the rigid ring as used within the system of the present invention.
Figure 8:
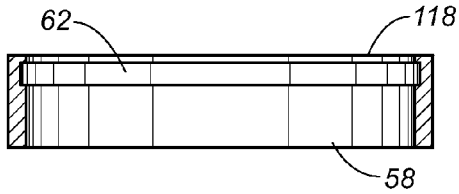
FIG. 8 is a cross-sectional view showing the rigid ring as used in the system of the present invention.

FIG. 6 shows an isolated view of the rigid ring 58. It can be seen that the rigid ring 58 has an annular construction and an open interior 130. As shown in broken line fashion, the notch 66 is located adjacent to the inner surface 92 of rigid ring 58. FIG. 7 also shows a side elevational view of the rigid ring 58. FIG. 8 shows that the notch 66 is located adjacent to the end 118 of the rigid ring 58. The notch 66 has a greater interior diameter than the remaining portion of the inner wall of the rigid ring 58.

Figure 9:
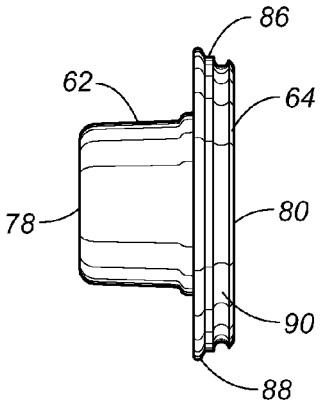
FIG. 9 is an isolated view showing the cap as used in the system of the present invention.

FIG. 9 is an isolated view of the cap 62 of the present invention. Cap 62 illustrated as having flanged end 64. A groove 90 extends around entirely the flanged end 64 so as to accommodate the O-ring elastomeric seal 82 (as shown in FIG. 3). Lip 88 extends outwardly of the outer wall 86 of flanged end 64. The cap 62 will have a closed end 78 and an open end 80. The outer wall 86 will extend outwardly and back toward the closed end 78 at the flanged end 64.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An anchor assembly for a post-tension system comprising:

an anchor member having an end surface;

a polymeric encapsulation covering said anchor member, said polymeric encapsulation having a tubular section extending outwardly of said end surface;

a rigid ring affixed within said tubular section, said rigid ring having a notch formed on an inner wall thereof; and a cap having a generally tubular body with an open end and a closed end, said cap having a flanged end adjacent said open end, said flanged end having an outer periphery engageable within said notch of said rigid ring.

2. The anchor assembly of claim 1, said flanged end having an end surface and an outer wall extending outwardly therefrom, said outer wall having a lip formed at an end thereof opposite said end surface, said lip being said outer periphery engageable within said notch.

3. The anchor assembly of claim 2, said outer wall having a groove formed in said outer wall, the assembly further comprising:

an elastomeric seal received within said groove and extending around said cap, said elastomeric seal being in generally liquid-tight engagement with said inner wall of said rigid ring.

4. The anchor assembly of claim 1, said rigid ring being of a steel material.

5. The anchor assembly of claim 1, said polymeric encapsulation being in injection molded relationship around an exterior surface of said rigid ring.

6. The anchor assembly of claim 1, said notch comprising a first notch formed around said inner wall of said rigid ring adjacent an end of rigid ring opposite said end surface of said anchor member.

7. The anchor assembly of claim 6, said notch comprising a second notch formed around said inner wall of said rigid ring adjacent an opposite end of said rigid ring, said second notch being in spaced parallel relationship to said first notch.

8. The anchor assembly of claim 1, further comprising:

a tendon affixed to said anchor member, said tendon having an end extending outwardly of said end surface of said anchor member and into said open end of said cap.

9. The anchor assembly of claim 1, said rigid ring having a tapered surface at an end thereof adjacent an end of said tubular section of said polymeric encapsulation opposite said end surface of said anchor member.

* * * * *